US005263636A

United States Patent [19]

Aure

[11] Patent Number: 5,263,636

[45] Date of Patent: Nov. 23, 1993

[54] PRODUCE CARTON STRENGHENING BRACKET AND PRODUCE CARTON

[76] Inventor: David A. Aure, Rte. 1, Box 112, Earlimart, Calif. 93219

[21] Appl. No.: 38,617

[22] Filed: Mar. 25, 1993

[51] Int. Cl.[5] ..... B65D 5/44

[52] U.S. Cl. ..... 229/199; 206/509; 229/919

[58] Field of Search ..... 229/198, 199, 23 R, 229/915, 919, DIG. 11; 206/509

[56] References Cited

U.S. PATENT DOCUMENTS

| | | | |
|---|---|---|---|
| 2,950,852 | 8/1960 | Hutchison | 229/199 |
| 3,015,431 | 1/1962 | Mulcoy | 229/915 |
| 3,878,980 | 4/1975 | Crane | 229/915 |
| 4,175,691 | 11/1979 | Cornell et al. | 229/915 |
| 4,807,756 | 2/1989 | Young et al. | 229/919 |
| 4,911,356 | 3/1990 | Townsend et al. | 229/DIG. 11 |
| 4,932,586 | 6/1990 | Young et al. | 206/509 |
| 5,016,811 | 5/1991 | Kapare | 229/915 |
| 5,163,611 | 11/1992 | Singer | 229/919 |

FOREIGN PATENT DOCUMENTS

| | | | |
|---|---|---|---|
| 2449605 | 9/1980 | France | 229/919 |
| 304718 | 9/1968 | Sweden | 229/DIG. 11 |

*Primary Examiner*—Gary E. Elkins
*Attorney, Agent, or Firm*—Stetina and Brunda

[57] ABSTRACT

A bracket for strengthening a produce carton and the resultant carton such as those commonly used to transport and store grapes has an upper beam portion extending along one end of the carton and configured to hook over that end of the carton; a lower beam portion extending along the same end of the carton and having detent means formed thereon for engaging at least one of the cutouts to removeably attach the bracket to the carton; and plural column portions rigidly attaching the upper beam portion to the lower beam portion. The lower beam portion has at least one stop formed thereon to prevent upward movement of the bracket after the detent means has engaged a cutout. The bracket is easily installed upon the carton by hooking the upper beam portion over the end of the carton and snapping the detent means of the lower beam portion into the cutouts.

20 Claims, 7 Drawing Sheets

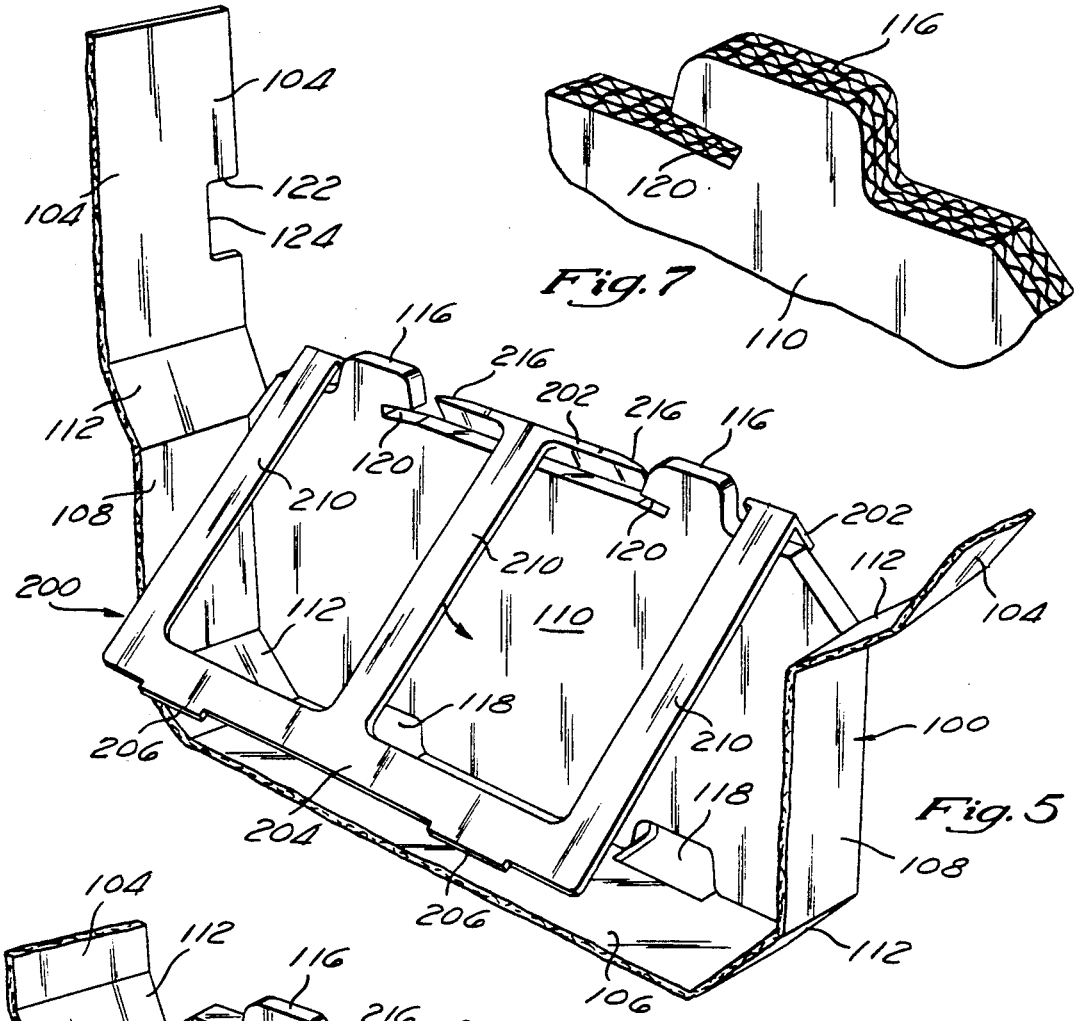
Fig. 7
Fig. 5
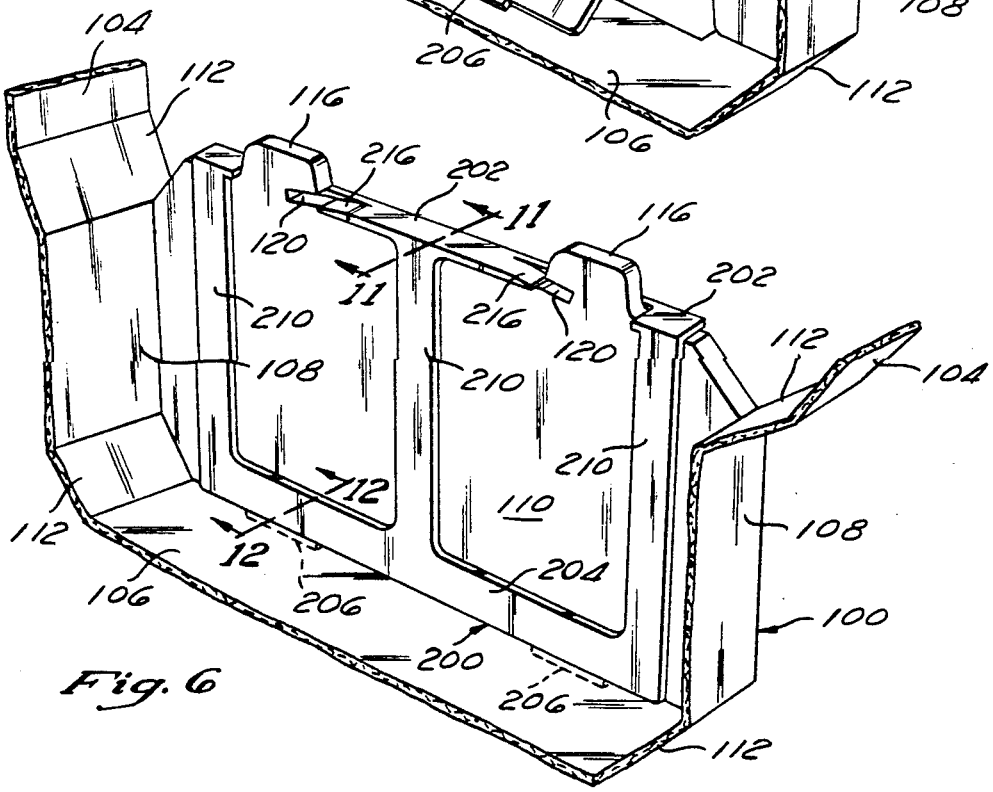
Fig. 6

PRODUCE CARTON STRENGHENING BRACKET AND PRODUCE CARTON

FIELD OF THE INVENTION

The present invention relates generally to containers and more particularly to a bracket for strengthening cartons and a strengthened carton used to store and transport produce such as grapes and the like.

BACKGROUND OF THE INVENTION

As is well known, the cost of transporting produce from the fields to the ultimate consumer is in a large degree determined by the gross weight of what is being shipped. Since it costs just as much per pound to transport the cartons in which the produce is shipped as the produce itself, it is desirable that the cartons weigh as little as possible. Thus, although wooden cartons are known, corrugated cardboard cartons are oftentimes utilized for shipping and cold storage of produce because of their low cost and low weight.

As such, although wooden cartons are commonly used, they are costly to manufacture and also substantially increase the cost of shipping due to their weight. In view of these cost considerations, packaging produce in corrugated cardboard cartons has become the preferred mode of transporting fresh produce. Although such corrugated cardboard cartons are thus commonly used because of their lower cost and lower weight, strength is sacrificed. Also, such corrugated cardboard cartons are subject to deterioration due to the effects of moisture thereon. Thus, a serious disadvantage of corrugated cardboard is that it lacks the structural strength of wood.

Additionally, wood produce cartons can not be recycled, whereas corrugated cardboard produce cartons can be recycled into various paper products.

The cost of cold storage and shipping of produce is also partially determined by the amount of floor space taken up thereby. Thus, it is necessary that such cartons be placed in relatively tall stacks to minimize floor space. This, of course, means that the cartons at the bottom of the stacks must be able to support the weight of those cartons stacked above.

Additionally, handling and transporting of the cartons exposes them to various forces which tend to twist or otherwise deform the corrugated cardboard from which they are formed. In particular, when the vehicle transporting the produce turns or sways, the inertia of the cartons causes the stacks to twist and sway. Since the stacks are held stationary only at the bottom, the twisting and swaying motion of the stacks causes a disproportionately large amount of torque to be applied to the walls of the lower cartons.

The produce being transported is frequently wet, and ambient moisture as well the moisture from the produce has a tendency to gradually saturate the corrugated cartons. When this occurs, the load and torque-bearing capacity of the corrugated cardboard cartons greatly diminishes. In this weakened state, the upper corners of the cartons have a tendency to distend outward. This allows the weight of the cartons stacked above to force a higher carton—formerly supported by the corners of a lower carton—to slide into the lower carton and damage the produce contained therein.

The twisting of the stacks may also cause a relatively weak portion of one of the wetted cartons to twist and mishappen, allowing the weight of the carton stacked above to crush the produce contained in the lower carton. In the worst case, the saturated corner of one of the lower cartons could so weaken that it completely buckles, thereby removing one of the corner supports from the stack and potentially causing the entire stack to collapse.

Because of the need to insure adequate ventilation of the produce contained therein and to assure effective control of its environment, i.e., temperature and humidity, prior art corrugated produce cartons are configured such that, when stacked, air channels are formed therebetween and thereinto. The uppermost and lowermost longitudinal corners of the cartons are beveled such that air conduits are formed along the region where four (4) stacked cartons abut. Apertures formed along the bevel of each carton provide air flow from the conduit into each carton.

Such conduits and apertures also facilitate the application of pesticides and the like or inert gases to reduce the likelihood of insect infestation and/or the growth of fungus.

By forming such bevels, the structural strength, i.e., the ability to withstand stacking, of each carton is substantially reduced. This exacerbates the problems associated with wetting of the cartons, thereby further shortening their useful life.

Stacking alignment tabs formed along the upper edge of each end of the carton are received into cutouts formed along the lower edge of each end of the carton to facilitate stacking thereof. During the stacking process, when one carton is placed atop another, the stacking alignment tabs of the lower carton are positioned within the cutout of the upper carton, thereby assuring proper alignment of the cartons in order form a straight vertical stack. This interlocking of adjacent cartons also makes each stack more stable, and thus less likely to topple over.

Although differences exists among different manufactures, such produce cartons are typically approximately 17 inches long, 14 inches wide, and 7 inches high. Also, the exact configuration of the stacking alignment tabs and the cutouts varies somewhat among manufactures.

Both Maxco, of Reedley, Calif. and Weyerhauser, of Bakersfield, Calif. manufacture such produce cartons.

The storage life of fruit stored in such cartons is typically limited not by degradation of the fruit, but rather by the limited storage life of the corrugated cardboard cartons. Degradation of the corrugated cardboard cartons due to moisture prevents such cartons from being used for extended periods of time.

In light of the problems associated with transporting and storing produce in corrugated cartons, it is desirable that the cartons be reinforced in some manner. It is important, however, that the means utilized to reinforce the corrugated cartons not add significantly to the weight, bulk, or cost of the cartons.

It is important that the carton design lend itself to simple and inexpensive mass production techniques. The corrugated portion of the carton should preferably be as simple as possible so that the number of cutting operations necessary to fabricate the cartons is minimized. Likewise, the reinforcing means itself should be inexpensive to manufacture and assemble into the finished carton.

It is also desirable that, in order to minimize inventory, the reinforced corrugated cardboard design incorporate a minimum number of parts, and that these parts be as light and compact as possible for easy handling and storage.

The process of assembling the reinforcing corrugated cartons should be as simple as possible. Every step in the process should be simple enough that it can be performed by machine.

Finally, although the corrugated portion of the reinforced cartons typically will be destroyed by moisture from the produce, it is desirable that the reinforcing means be recyclable, in order that material costs will be minimized.

Necessarily, the recycling process will only be cost effective if used cartons can be simply and easily disassembled. Preferably, the disassembling process should be performable without tools of any kind and without the necessity of undue care being required in order to insure that the reinforcing means is not damaged. Thus, it would be beneficial to provide a simple and effective means of reinforcing corrugated produce cartons so that they, even when wet, will be able to support the weight of the cartons stacked above them, and bear the torque applied upon them due to the twisting and swaying of the stacked cartons.

As such, although the prior art has recognized to a limited extent the problem of increasing the strength of cardboard produce cartons, the proposed solutions to date have been ineffective in providing a satisfactory remedy.

SUMMARY OF THE INVENTION

The present invention addresses and alleviates the above mentioned deficiencies associated with the prior art. More particularly, the present invention comprises a bracket for strengthening a produce carton and a resultant strengthened produce carton specifically adapted for use with fragile perishable fruit such as table grapes and the like. The bracket comprises an upper beam portion extending along one end of the carton and having a flange configured to hook over that end of the carton; a lower beam portion extending along the same end of the carton and having detent means formed thereon for fictionally engaging at least one of the cutouts formed along the bottom of the ends of the carton to removably attach the bracket to the carton, the lower beam portion also having at least one stop formed thereon to prevent upward movement of the bracket after the detent means have engaged the cutouts; and plural column portions rigidly attaching the upper beam portion to the lower beam portion. The bracket is easily installed upon the carton by hooking the upper beam portion over the end of the carton and then snapping i.e. fictionally engaging the detent means of the lower beam portion into the cutouts.

The upper beam portion preferably comprises a horizontally oriented substantially planar member having at least one hook member depending therefrom.

The lower beam portion preferably comprises a vertically oriented substantially planar member and the detent means formed thereon preferably comprises two downwardly extending members. The stop formed thereon preferably comprises two substantially planer members extending perpendicularly from the lower beam portion so as to abut the side of the carton within the cutout.

Each stop abuts the side of the cartons along the upper edge of each cutout. That is, the stop extends into the cutout and abuts the side at the upper edge of the cutout such that the bracket can not move vertically upward. The detent members prevent the lower portion of the bracket from moving in an inward direction, i.e. toward the center of the produce carton. The hook members of the upper beam portion similarly prevent the upper portion of the produce carton strengthening bracket from moving inward. Thus, once snapped into place, the produce carton strengthening bracket of the present invention is locked into position and can only be removed by slightly deforming the bottom of the carton to permit the detent members to disengage the cutout.

The plural column portions preferably comprise a plurality of substantially planer members extending vertically intermediate the upper beam portion and the lower beam portion.

Three embodiments of the produce carton strengthening bracket of the present invention are disclosed herein. The first embodiment of the produce carton strengthening bracket is configured for use with a conventional prior art produce carton manufactured by Maxco of Reedley, Calif. The second embodiment of produce carton strengthening bracket is configured for use with a produce carton manufactured by Weyerhauser of Bakersfield, Calif. The third embodiment of the produce carton strengthening bracket for use with a modified Maxco produce carton.

The modification to the standard Maxco produce carton comprises removing the stacking alignment tabs, reconfiguring the top flaps, and enlarging the size of the cutouts. The stacking alignment tabs are removed such that new stacking alignment tabs integrally formed upon the produce carton strengthening bracket may be utilized. The flaps are modified to engage the new stacking alignment tabs to facilitate closing of the carton. The cutouts are enlarged to accommodate the insertion of stops which fully cover the side and top walls thereof and which are configured to receive complementary stacking alignment tabs from a lower stacked produce carton.

Thus, the bracket may optionally comprise rigid stacking tabs and/or complete reinforcing cutout walls. Since the cardboard stacking alignment tabs are particularly susceptible to deterioration due to moisture and use, it is beneficial to replace the cardboard alignment tabs with rigid alignment tabs integrally formed with the carton strengthening bracket.

By additionally forming the stops to define complete cutout reinforcing walls, the entire load resulting from a plurality of such cartons stacked on top another is transferred from each higher carton to each lower carton through the bracket alone, thus substantially reducing the required load bearing ability of the cardboard carton itself.

The stops are formed to define complete cutout reinforcing walls by extending each stop—which otherwise covers only a portion of the top wall of each cutout—to cover substantially all of the cardboard edges of the cutout, thus forming a well or pocket within which the stacking alignment tabs of a lower carton are received such that the stacking alignment tabs do not contact the cardboard of the upper carton, but rather contact only the strengthening bracket within the cutouts.

Alternatively, rather than replacing the existing cardboard stacking alignment tabs with tabs integrally formed upon the carton strengthening bracket, the carton strengthening bracket may optionally be formed to have a stacking alignment tab brace which extends over an existing cardboard stacking alignment tab to provide added strength thereto without requiring that the existing cardboard stacking alignment tab be removed from the carton.

The brace preferably comprises a cover or pocket which extends over substantially the entire stacking alignment tab, thereby forming a strengthened support layer thereover. Because of the size added to the cardboard stacking alignment tab by such a brace, it will typically be necessary to increase the size of the cutout formed in the carton. Brackets utilizing such a stacking alignment tab brace preferably also utilize complete cutout support walls defined by the stop to accommodate such a brace and thereby enhance the load bearing capability of the carton as described above.

Thus, these as well as other advantages of the present invention will be more apparent from the following description and drawings. It is understood that changes in the specific structure shown and described may be made within scope of the claims without departing from the spirit of the invention.

BRIEF DESCRIPTION OF THE DRAWING

FIG. 5 is a fragmentary perspective view showing the inside of one end of the Maxco produce carton of FIGS. 1 and 2 and illustrating the installation procedure utilized with the first embodiment of the produce carton strengthening bracket of the present invention;

FIG. 6 is a fragmentary perspective view showing the carton of FIG. 5 after the strengthening bracket has been installed therein;

FIG. 7 is an enlarged fragmentary perspective view of a stacking alignment tab of the Maxco produce carton FIGS. 1, 2, 5, and 6;

DETAILED DESCRIPTION OF THE PREFERRED EMBODIMENT

The detailed description set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
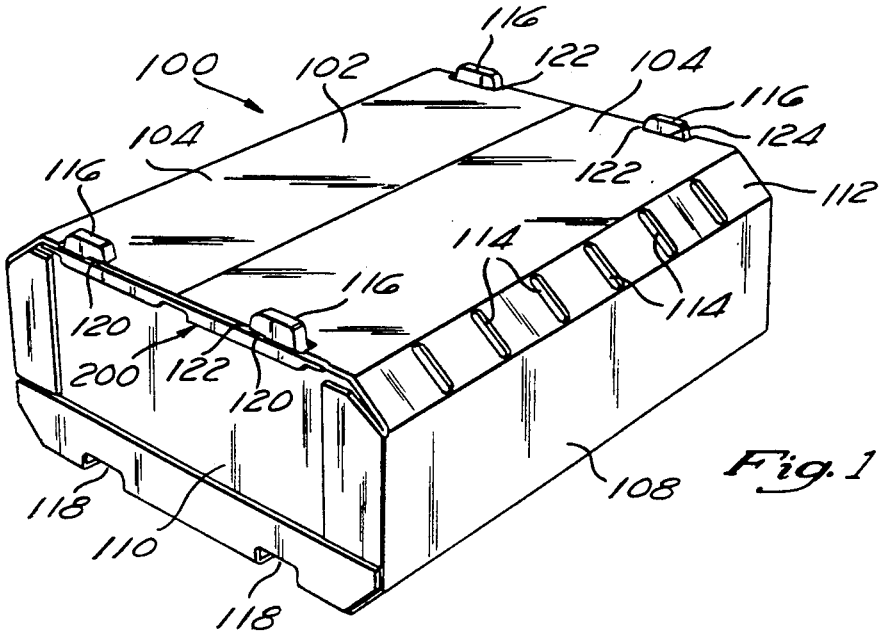
FIG. 1 is a perspective view of a standard Maxco produce carton having a first embodiment of the strengthening bracket of the present invention installed therein and showing the carton in a closed configuration.
Figure 2:
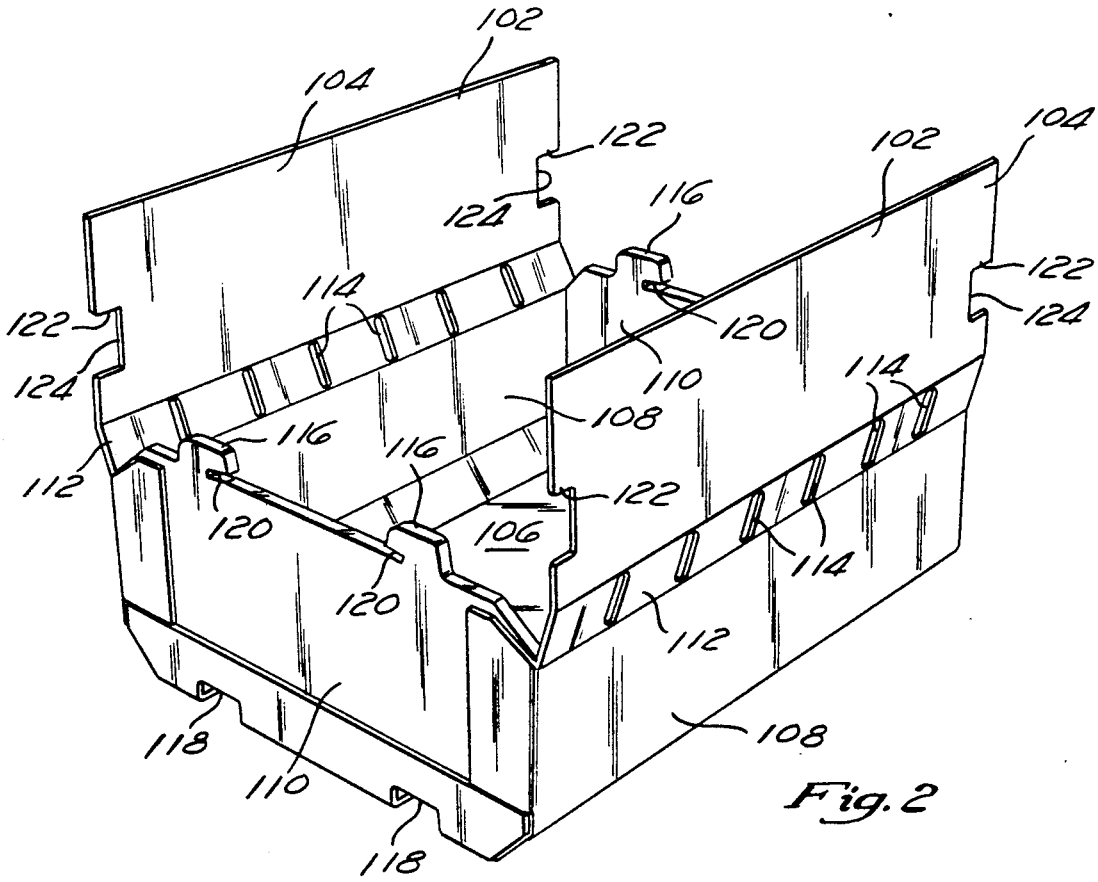
FIG. 2 is a perspective view of the prior art Maxco produce carton not having a strengthening bracket of the present invention installed therein showing the carton in a open configuration.

The produce carton strengthening bracket of the present invention is illustrated in FIGS. 1 and 3 through 23 of the of the drawings which depict three presently preferred embodiments of the invention. FIG. 2 shows a standard Maxco produce carton without a produce carton strengthening bracket installed therein. Referring now to FIGS. 1, 2 and 7, a first embodiment of the present invention 100 generally comprises a top 102 having flaps 104; a bottom 106; two sides 108; and two ends 110.

Stacking alignment tabs 116 (best seen in FIG. 7) extend upwardly from each end 110 of the carton. Corresponding cutouts 118 are formed along the lower edge of each end 110 of the first embodiment of the present invention 100 such that upper or superior first embodiment of the present invention 100 in a stack receive the stack alignment tabs 116 of lower or inferior first embodiment of the present invention 100 into the cutouts 118 thereof. This facilitates easy alignment of an upper carton with a lower carton and also interlocks adjacent stacked cartons together to provide for more secure stacking.

With particular reference to FIG. 7, each stacked alignment tab 116 has a slot 120 formed therein. The slot 120 formed within each stacking alignment tab 116 receives a tab 122 formed upon the flaps 104 to facilitate closing of the first embodiment of the present invention 100. Cutouts 124 formed in each flap 104 provide clearance for and receive the stack alignment tabs 116.

Figure 8:
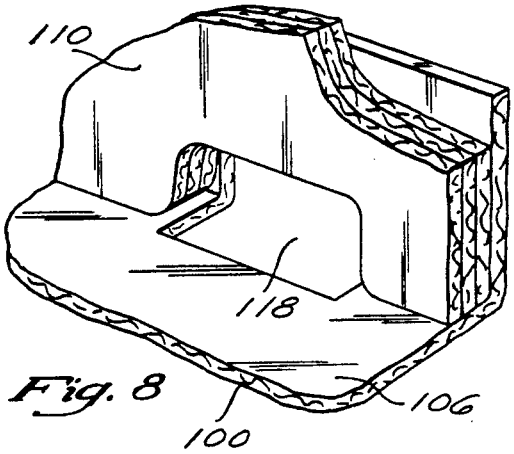
FIG. 8 is an enlarged fragmentary perspective view of a cutout of the Maxco produce carton of FIGS. 1, 2, 5, and 6 as seen from the interior of the carton.

With particular reference to FIG. 8, each cutout 118 is formed at the intersection of the end 110 and bottom 106. The cutouts 118 are sized and configured to receive the stacking alignment tabs 116 of lower stacked cartons.

Longitudinally extending bevels 112 are formed at the intersections of the sides 108 and the top 102 as well as at the intersections of the sides 108 and the bottom 106. Each of the four bevels 112 has a plurality of apertures 114 formed therethrough to provide free air circulation between the interior and exterior of the first embodiment of the present invention 100.

The bevels 112 of four adjacent stacked cartons (two cartons in each of two adjacent stacks wherein all four cartons would abut along a common line at their interface if not for the bevels 112) form air conduits intermediate the four adjacent stacked cartons to further facilitate air circulation between the interior of the cartons and their environment. Such air circulation facilitates maintenance of desired temperature and humidity within the cartons and also facilitates the circulation of pesticides, fungicides, and the like, as well as inert gases, through the interiors of the cartons to minimize infestation by insects, parasites, and like.

With particular reference to FIG. 1, a produce carton strengthening bracket 200 is disposed at either end of the first embodiment of the present invention 100 such that the structural strength and load bearing capacity of the first embodiment of the present invention 100 is increased.

The use of such a produce carton strengthening bracket 200 allows a plurality of such produce cartons to be stacked, one atop another, and maintained in such a stacked configuration for a prolonged length of time. Since moisture does not effect the structural strength of the produce carton strengthening bracket 200, the structural strength provided thereby does not deteriorate over time as does the structural strength of the cardboard portions of the first embodiment of the present invention 100. Thus, the structural strength required for such stacking is maintained the produce cartons containing grapes and the like may be stored and/or transported for an increased length of time.

The strengthening bracket is preferably comprised of a structural material, such as injection molded plastic, i.e., preferably ABS or PVC, the strength of which is not substantially affected by the presence of moisture. Those skilled in the art will recognize various other structural materials, i.e., wood, metals, etc., are likewise suitable.

Figure 3:
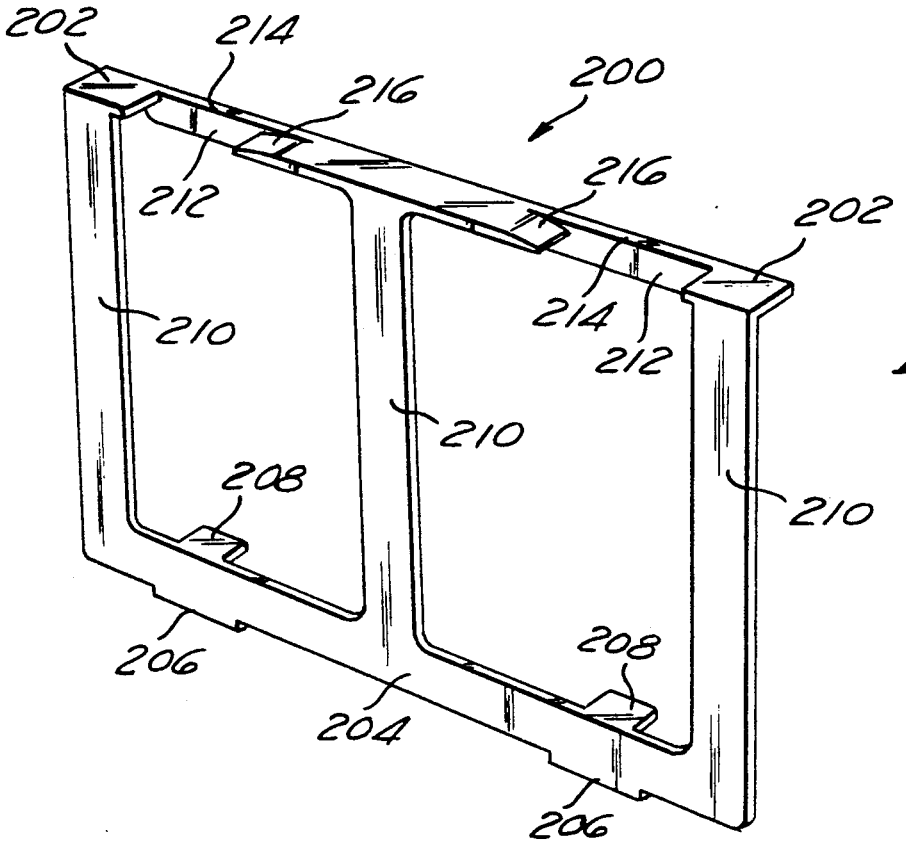
FIG. 3 is a perspective view of a first embodiment of the produce carton strengthening bracket of the present invention, showing the inboard side thereof.
Figure 4:
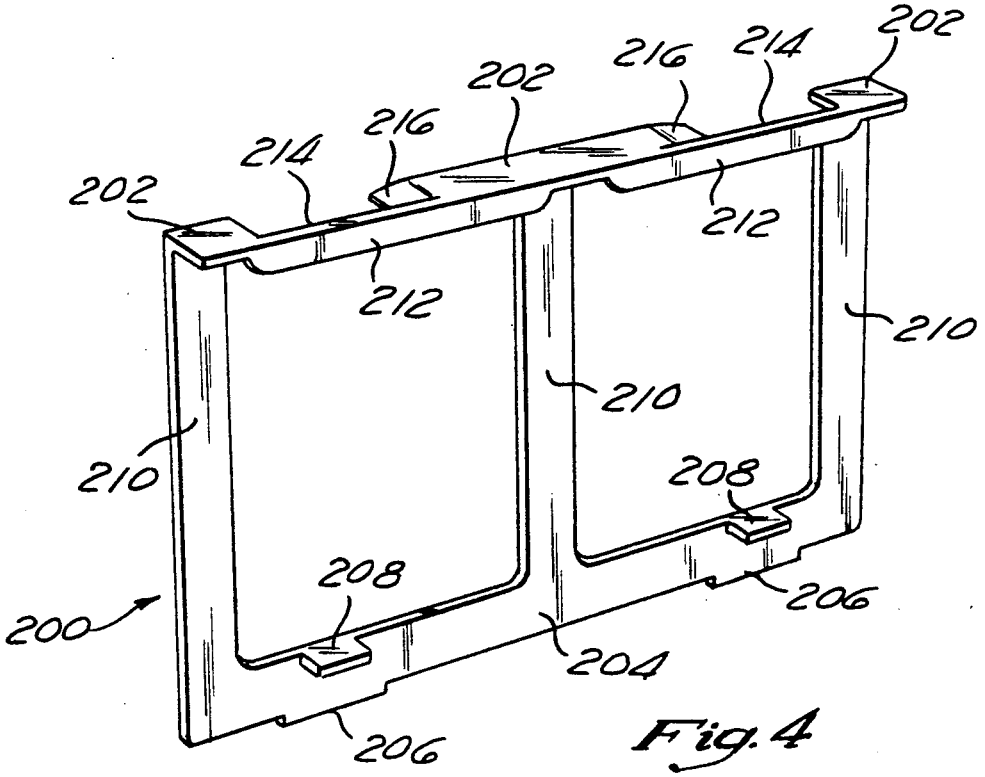
FIG. 4 is a perspective view of the produce carton strengthening bracket of FIG. 3, showing the outboard side thereof.

Referring now to FIGS. 3 and 4, the first embodiment of the produce carton strengthening bracket 200 of the present invention is configured for use with Maxco produce cartons and generally comprises an upper beam portion 202 which extends along one end 110 of the first embodiment of the present invention 100 and is configured to hook over that end 110 of the first embodiment of the present invention 100; a lower beam portion 204 extends along the same end 110 of the first embodiment of the present invention 100 and has detent means, preferably two downwardly extending detent members 206, formed thereon for engaging at least one, preferably both, of the cutouts 118 of the produce carton to removably attached the bracket thereto and also having at least one, preferably two, stops 208 formed thereon to prevent upward movement of the strengthening bracket 200 after the detent means 206 engage the cutouts 118; and plural column portions 210 rigidly attaching the upper beam portion 202 to the lower beam portion 204.

Those skilled in the art will recognize that various configurations of the plural column portions 210 are suitable. Any number of vertical or slanted members or any other interconnecting structures are likewise suitable. Indeed, a solid, preferably substantially planar, interconnecting member may optionally be utilized.

The produce carton strengthening bracket 200 is easily installed in the first embodiment of the present invention 100 by hooking the upper beam portion 202 over the end 110 of the first embodiment of the present invention 100, swinging the lower beam portion 204 downward and outboard, and snapping the detent members 206 into the cutouts 118, as discussed in further detail with reference to FIG. 5 below.

The upper beam portion 202 preferably comprises a horizontally oriented substantially planer member having at least one hook member 212 depending downwardly therefrom. The hook member 212 is configured to capture the upper edge of an end 110 in the first embodiment of the present invention 100 intermediate itself and the upper portion of the plural column portions 210. Cutouts 214 formed in the upper beam portion 202 receive the stacking alignment tabs 116 of the first embodiment of the present invention 100. Ramped portions 216 are formed to provide ample clearance for the tabs 122 of the flaps 104 as they are received within the slots 120 of the stacking alignment tabs 116.

The lower beam portion 204 preferably comprises a vertically oriented substantially planer member upon which the detent members 206 and stops 208 are formed.

The plural column portions 210 preferably comprise a plurality of substantially planer members extending vertically intermediate the upper beam portion 202 and the lower beam portion 204 and are preferably formed integrally with the upper beam portion 202 and the lower beam portion 204.

Having thus described the structure of the produce carton strengthening bracket at the first embodiment of the present invention, it may be beneficial to describe the use thereof. Referring know to FIGS. 5–12, installation of the strengthening bracket of the present invention into a standard Maxco carton is illustrated. Such installation may be performed either at the factory or by the end user prior to disposing produce within the carton.

With particular reference to FIG. 5, the produce carton strengthening bracket 200 is installed into a first embodiment of the present invention 100 by first hooking the upper beam portion 202 thereof over the upper edge of the end 110 of the first embodiment of the present invention 100. Next, the lower beam portion 204 is swung downwardly and outboard until the interconnecting members 210 and the lower beam portion 204 are substantially laminarly juxtaposed to the end 110 and the detent members 206 engage the cutouts 118 of the first embodiment of the present invention 100. Thus, the produce carton strengthening bracket 200 of the present invention simply snaps into place such that it is easily installed without requiring any tools.

Figure 9:
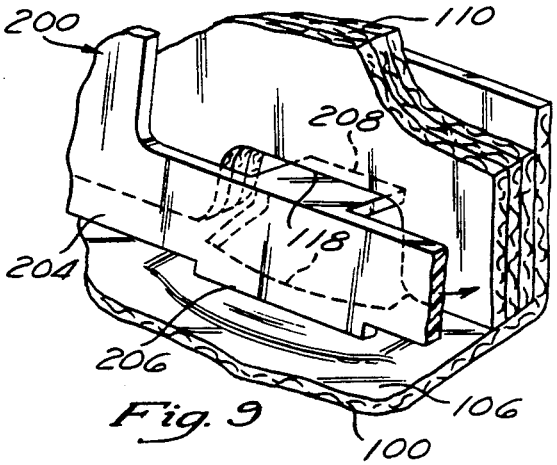
FIG. 9 is an enlarged fragmentary perspective view of the cutout of FIG. 8 having a stop of the first embodiment of the produce carton strengthening bracket about to engage therewith.

With particular reference to FIG. 6, since the detent members 206 are disposed within and engage the cutouts 118, the lower beam portion 204 is prevented from moving inboard. Additionally, as best shown in FIG. 9, the stops 208 abut the upper surfaces of the cutouts 118 and thus prevent upward motion of the produce carton strengthening bracket 200.

Thus, the produce carton strengthening bracket 200 is held firmly in place within the first embodiment of the present invention 100 and is positioned to receive a substantial portion of the load applied by any above stacked produce cartons and to transmit the load to similarly installed strengthening brackets of any lower stacked produce cartons.

The produce carton strengthening bracket 200 may be removed from the first embodiment of the present invention 100 by first disengaging the detent members 206 from the cutouts 118, i.e., by deforming the bottom 106 of the first embodiment of the present invention 100 downward, and then swinging the lower beam portion 204 inboard and upward to unhook the upper beam portion 202 from the upper portion of the end 110 of the first embodiment of the present invention 100. The produce carton strengthening bracket 200 of the present invention may thus be removed and recycled. Such recycling may comprise reinstallation of the produce carton strengthening bracket of the present invention into another produce carton or reuse of the plastic of which it is comprised. Thus, even though the cardboard produce carton in which the produce carton strengthening bracket of the present invention is used may deteriorate substantially due to moisture, and thus not be reusable, the produce carton strengthening bracket itself may typically be reused indefinitely.

Figure 10:
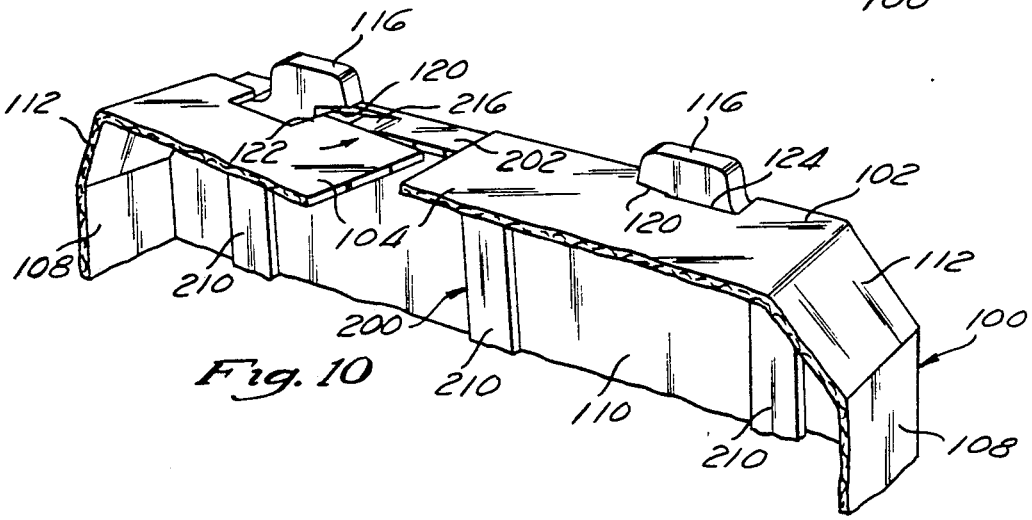
FIG. 10 is an enlarged fragmentary perspective view of the upper end portion of a Maxco produce carton having a produce carton strengthening bracket of the first embodiment installed therein and illustrating the locking of the top flaps into the stacking alignment tab.

With particular reference to FIG. 10, the first embodiment of the present invention 100 is closed by simply inserting the tabs 122 formed upon the flaps 104 into the cutout 120 of the stacking alignment tabs 116, thus locking the top 102 in a closed configuration. Ramps 216 formed upon the upper beam portion 202 facilitate easy insertion of the tabs 122 into the cutouts 120 by providing ample clearance therefore such that the upper beam portion 202 of the produce carton strengthening bracket 200 does not interfere with such insertion.

Figure 11:
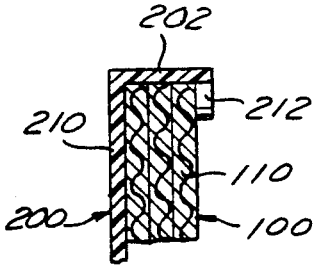
FIG. 11 is a fragmentary cross-sectional view taken along lines 11 of FIG. 6.

With particular reference to FIG. 11, the downwardly depending hook member 212 of the upper beam portion 202 cooperates with the upper portion of each interconnecting member 210 to capture the upper portion of the end 110 of the first embodiment of the present invention 100 therebetween.

Figure 12:
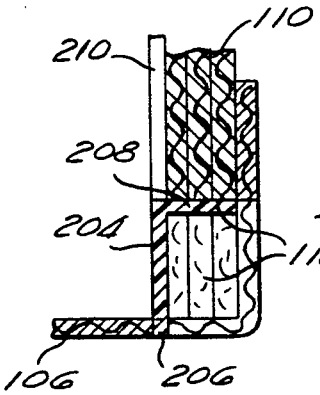
FIG. 12 is a fragmentary cross-sectional view taken along lines 12 of FIG. 6.

With particular reference to FIG. 12, each stop 208 abuts the uppermost portion of each cutout 118 to prevent upward movement of the produce carton strengthening bracket 200.

The second embodiment of the produce carton strengthening bracket 300 of the present invention is configured for use with the second embodiment of the present invention 500. The Weyerhauser produce cartons used in the first embodiment of the present invention differ from the Maxco produce cartons used in the second embodiment of the present invention primarily in the configuration of the stacking alignment tabs and cutouts. There are also small differences in their overall dimensions.

Figure 13:
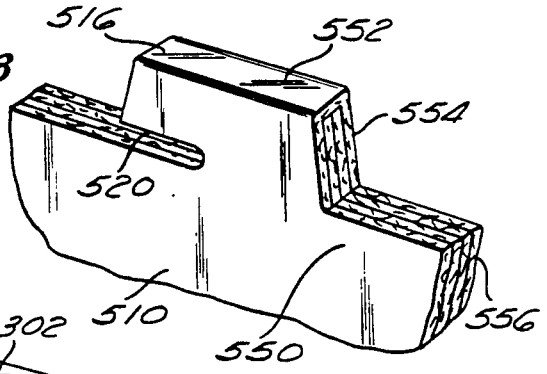
FIG. 13 is a fragmentary perspective view showing a stacking alignment tab of a Weyerhauser produce carton for which the second embodiment of the produce carton strengthening bracket of the present invention is utilized.
Figure 16:
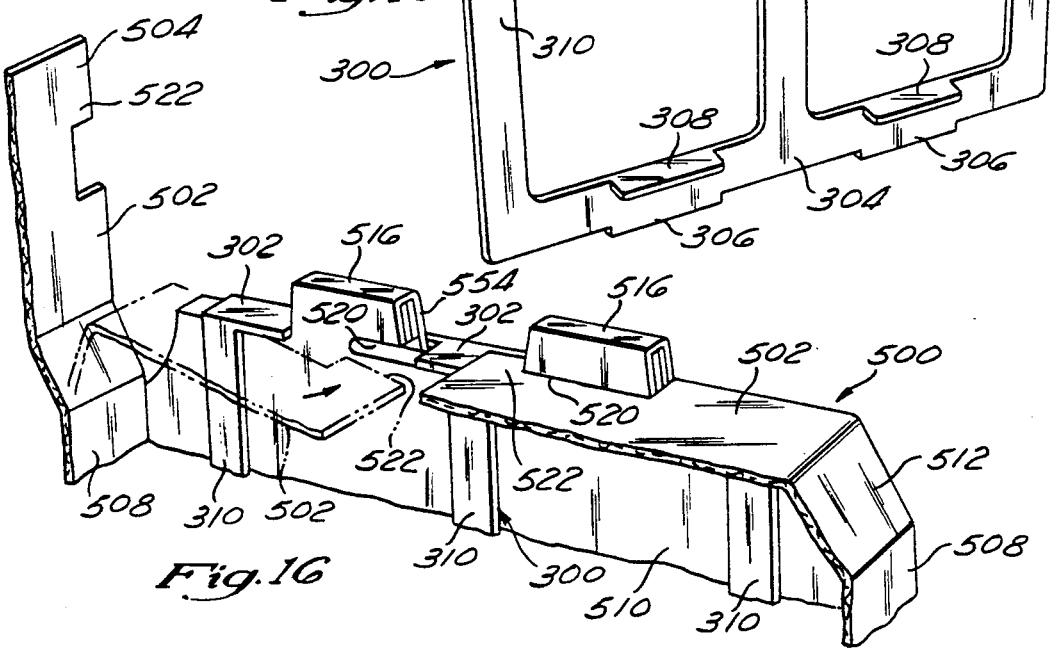
FIG. 16 is an enlarged fragmentary perspective view of the upper end portion of a Weyerhauser produce carton having a produce carton strengthening bracket of the second embodiment of the present invention installed therein and illustrating the locking of the top flaps into the stacking alignment tab.

Referring now to FIG. 13, the Weyerhauser stacking alignment tab 516 comprises a cutout 522 as does the Maxco stacking alignment tab 116. However, in the Weyerhauser stacking alignment tab 516 the inboard layer 550 of the end 510 folds over and forms the upper surface 552 of the stacking alignment tab 516 and further folds down over the outboard portion 554 thereof and continues downward to form the outer most layer 556 of the end 510. That is the inboard 550 and outboard 554 layers of the stacking alignment tab 516 are formed from a single layer of cardboard which folds over to sandwich or envelope the innermost two layers of the stacking alignment tab 516. Additionally, the cutout 520 of the Weyerhauser produce carton's stacking alignment tab is closed on the outboard side by the outermost cardboard ply 554 (as best shown in FIG. 16).

Figure 17:
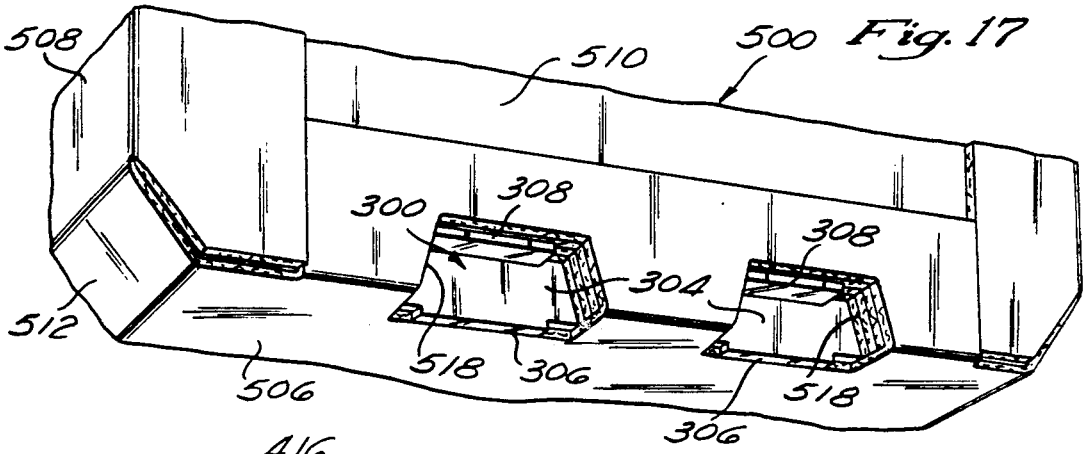
FIG. 17 is an enlarged fragmentary perspective view showing the stops of the second embodiment of the produce carton strengthening bracket of the present invention engaging the upper surfaces of the cutouts of a Weyerhauser carton and showing the detent members thereof engaging the cutouts.

Referring now to FIG. 17, the cutouts 518 of the Weyerhauser produce carton are somewhat larger than those of the Maxco produce carton and are also slightly closer together. Thus, it is necessary to utilize a second embodiment of the produce carton strengthening bracket of the present invention to effect strengthening of the Weyerhauser produce carton, because the configuration differences between the Weyerhauser produce carton and the Maxco produce carton prevent the first embodiment of the present invention from being utilized with the Weyerhauser produce carton.

Figure 14:
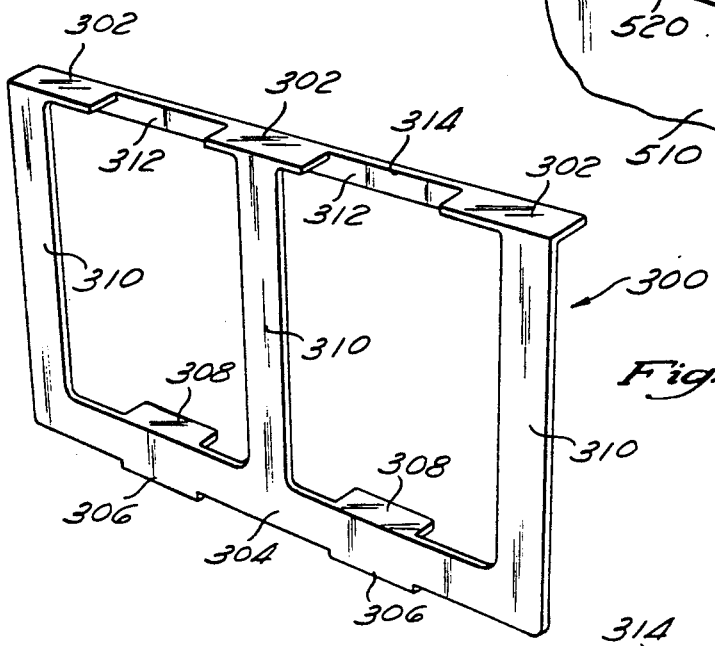
FIG. 14 is a perspective view of a second embodiment of the produce carton strengthening bracket of the present invention, showing the inboard side thereof.
Figure 15:
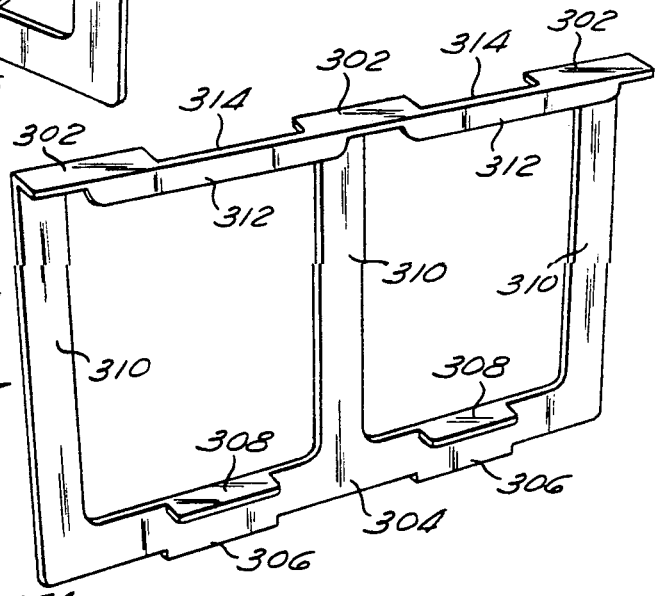
FIG. 15 is a perspective view of the produce carton strengthening bracket of FIG. 14, showing the outboard side thereof.

Referring now to FIGS. 14 and 15, like the first embodiment of the produce carton strengthening bracket, the second embodiment of the produce carton strengthening bracket generally comprises an upper beam portion 302 which extends along one 510 of the second embodiment of the present invention 500 (FIGS. 16 and 17) and is configured to hook over that end 510 of the second embodiment of the present invention 500; a lower beam portion 304 extends along the same end 510 of the second embodiment of the present invention 500 and has detent means, preferably two downwardly extending detent members 306, formed thereon for engaging at least one, preferably both, of the cutouts 118 of the produce carton to removably attach the bracket thereto and also having at least one, preferably two stops 308 formed thereon to prevent upward movement of the strengthening bracket 300 after the detent means 306 engage the cutouts 318; and plural column portions 310 rigidly attaching the upper beam portion 303 to the lower beam portion 304.

As in the first embodiment of the produce carton strengthening bracket of the present invention, the upper beam portion 302 of the second embodiment of the produce carton strengthening bracket preferably comprises a horizontally orientated substantially planer member having at least one hook member 312 pending downwardly therefrom. The hook member 312 is configured to capture the upper edge of an end 510 of the second embodiment of the strengthening bracket of the present invention 500 intermediate itself and the upper portion of the plural column portions 310. Cutouts 314 formed in the upper beam portion 302 receive the stacking alignment tabs 516 of the second embodiment of the present invention 500.

In the second embodiment of the produce carton strengthening bracket of the present invention, the cutouts 314 are made sufficiently long to eliminate the need for the ramps 216 as utilized in the first embodiment thereof. That is, the cutouts 314 are made sufficiently long that they do not interfere with the insertion of the tabs 522 of the flaps 502 of the second embodiment of the present invention 500 into the cutouts 522 of the alignment stacking tabs 516 thereof.

The second embodiment of the produce carton strengthening bracket of the present invention is installed into the Weyerhauser produce carton and removed therefrom in a like manner to that of the first embodiment thereof.

Referring now to FIG. 16, the second embodiment of the strengthening bracket of the present invention 500 is closed by simply inserting the tabs 522 formed upon the flaps 504 into the cutouts 520 o the stacking alignment tabs 516, thus locking the top 502 in a closed configuration.

Referring know to FIG. 17, the cutouts 518 formed in the second embodiment of the present invention 500 are sized and configured differently from than those of the first embodiment of the present invention 100. More particularly, the sides of the cutouts 518 are angled and the cutouts 518 of the second embodiment of the present invention 500 are somewhat closer together than those of the first embodiment of the present invention 100. This, of course, makes it necessary for the detent members 306 and stops 308 of the second embodiment of the produce carton strengthening bracket 300 to be closer together than those of the first embodiment thereof.

Figure 18:
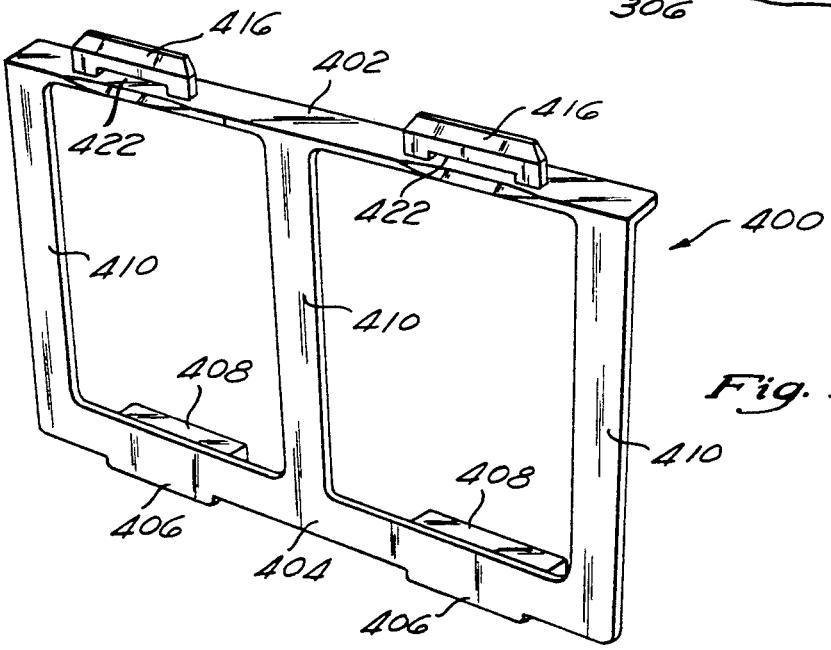
FIG. 18 is a perspective view of a third embodiment of the produce carton strengthening bracket of the present invention, showing the inboard side thereof.
Figure 19:
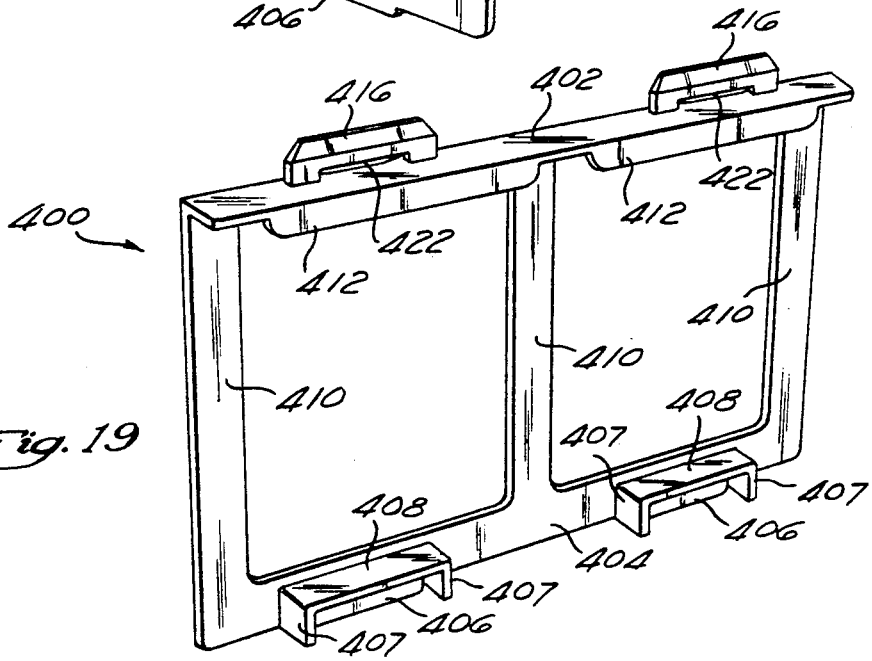
FIG. 19 is a perspective view of the produce carton strengthening bracket of FIG. 18, showing the outboard side thereof.

Referring now to FIGS. 18 and 19, the third embodiment of the produce carton strengthening bracket 300 of the present invention, like the first and second embodiments thereof, generally comprises an upper beam portion 402 which extends along one end 610 of a third embodiment of the present invention 600 and is configured to hook over that end 610 of the third embodiment of the present invention 600; a lower beam portion 404 extends along the same end 610 of the third embodiment of the present invention 600 and has detent means, preferably two downwardly extending detent members 406, formed thereon for engaging at least one, preferably both of the cutouts 618 of the third embodiment of the present invention 600 to removably attach the bracket thereto and also having at least one, preferably two stops 408 formed thereon to prevent upward movement of the produce carton strengthening bracket 400 after the detent means 406 engage the cutouts 618; and plural column portions 410 rigidly attaching the upper beam portion 402 to the lower beam portion 404.

The third embodiment of the produce carton strengthening bracket of the present invention differs from the first and second embodiments thereof primarily in that stacking alignment tabs 416 are formed upon the upper beam portion 402 thereof, thus replacing the stacking alignment tabs which would otherwise be formed upon the third embodiment of the present invention 600 itself and; also having a stop 408 which includes downwardly extending sidewalls 407, thus forming a pocket or enclosure to receive the stacking alignment tabs 416 of lower stacked produce cartons. Each stacking alignment tab 416 comprises a slot 422 formed therein for receiving the tab 622 of the modified Maxco flap 602.

Figure 20:
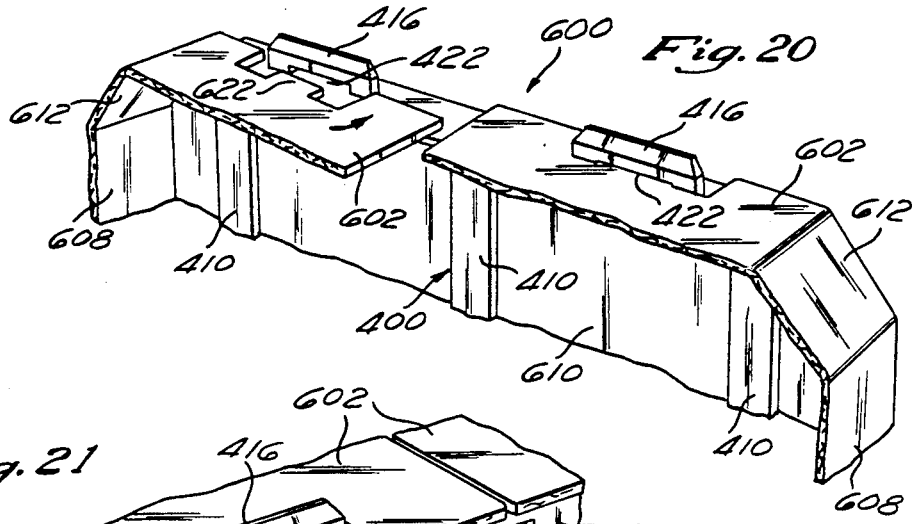
FIG. 20 is an enlarged fragmentary perspective view of the upper end portion of a modified Maxco produce carton illustrating the locking of the top flap into the stacking alignment tab integrally formed with the produce carton strengthening bracket of the third embodiment of the present invention.
Figure 21:
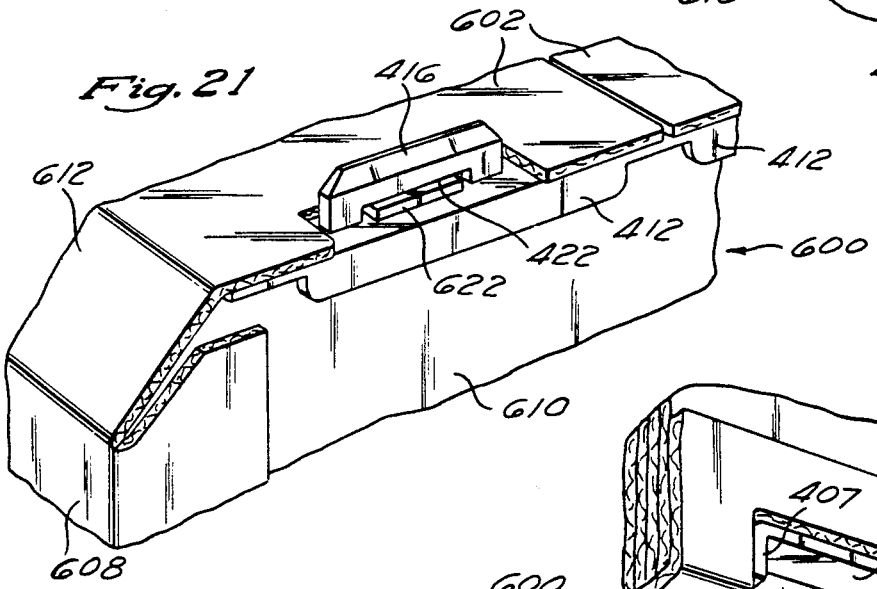
FIG. 21 is an enlarged fragmentary perspective view of one of the stacking alignment tabs of FIG. 20 having the top flap locked therein.
Figure 22:
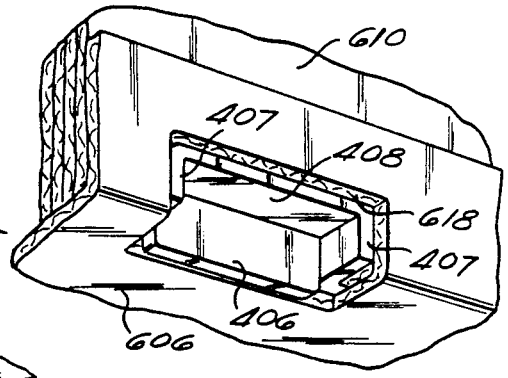
FIG. 22 is an enlarged fragmentary perspective view showing the stop of the third embodiment of the produce carton strengthening bracket of the present invention engaging the upper surface of a cutout of a modified Maxco carton wherein the stop has been configured to substantially cover the entire upper and side surfaces of the cutout and to receive a complimentary stacking alignment tab therein and also showing engagement of the detent member within the cutout.

Referring now to FIGS. 20 and 21, the tab 622 of each flap 602 is received within the slot 422 of each stacking alignment tab 416 to close the third embodiment of the present invention 600. Each flap 602 of the third embodiment of the present invention 600 have been modified to form tabs 622 which are configured to be received within slots 422 of the stacking alignment tabs 416.

The third embodiment of the product carton strengthening bracket of the present invention is installed and removed in a manner like the produce carton strengthening brackets of the first and second embodiments.

Figure 23:
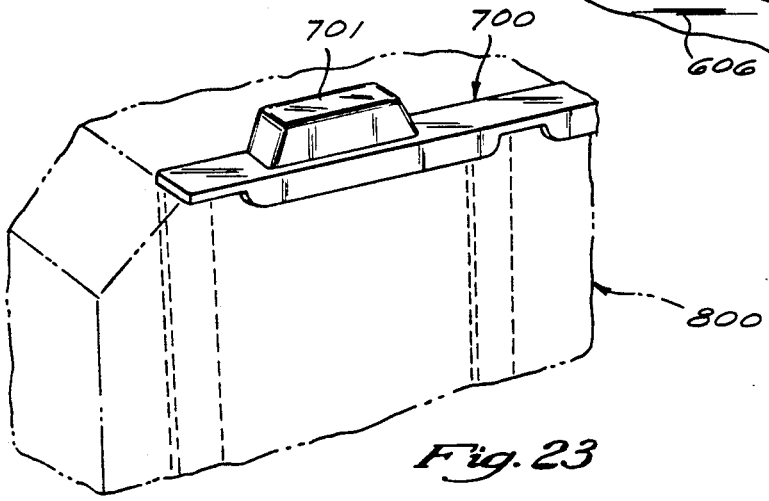
FIG. 23 is a fragmentary perspective view showing an optional covering or brace formed over a conventional produce carton stacking alignment tab.

Referring now to FIG. 23, the produce carton strengthening bracket 700 of the present invention may alternatively comprise a brace 701 configured to envelope at least a portion, preferably all, of each stacking alignment tab formed upon produce carton 800, thus increasing the structural strength thereof. That is, by providing such a brace 701, degradation of the stacking alignment tabs does not result in weakening of the produce carton. The use of such a brace 701 will typically necessitate enlargement of the complimentary cutouts of the produce carton such that they will be capable of receiving the brace 701.

The discussion and illustration of the produce carton strengthening brackets provided herein are with respect to Maxco and Weyerhauser produce cartons. The use of Maxco and Weyerhauser produce cartons is by way of example only and not by way of limitation. Those skilled in the art will recognize that the produce carton shipping brackets of the present invention may be utilized with produce cartons fabricated by various manufactures and in various other configurations. Indeed, the strengthening brackets of the present invention may be utilized with various other types of shipping and/or storage containers.

Furthermore, it is understood that the exemplary produce carton strengthening brackets described herein as shown in the drawings represent only presently preferred embodiments of the invention. Indeed, various modifications and additions may be made to such embodiments without departing from the spirit and scope of the invention. For example, various configurations of the upper beam portion, lower beam portion, and plural column portions are contemplated. These members, particularly the lower beam portion and plural column portions, need not be substantially planer in configuration, but rather may be of various other configurations. Also, those skilled in the art will recognize that the stops and detent members may be formed to have various shapes and configurations while functioning as intended. Thus, these and other modifications and additions may be obvious to those skilled in the art and may be implemented to adapt the present invention for use in a variety of different applications.

What is claimed is:

1. A bracket for strengthening a produce carton, the carton having a bottom, sides, and ends, cutouts being formed adjacent the intersection of the bottom and ends, the bracket comprising:

a) and upper beam portion extending along one end of the carton and configured to hook over that end of the carton;

b) a lower beam portion extending along the same end of the carton and having detent means formed thereon for engaging at least one of the cutouts to removably attach the bracket to the carton, the lower beam portion also having at least one stop formed thereon for engaging at least one of the cutouts to prevent upward movement of the bracket after the detent means have engaged the cutouts;

c) plural column portions rigidly attaching said upper beam portion to said lower beam portion; and d) wherein the bracket is disposed within the carton by hooking the upper beam portion over the end of the carton and snapping the detent means of the lower beam portion into the cutouts.

2. The bracket as recited in claim 1 wherein said upper elongate member comprises a horizontally oriented substantially planar member having at least one hook member depending therefrom.

3. The bracket as recited in claim 1 wherein:

(a) said lower beam portion comprises a vertically oriented substantially planer member;

(b) said detent means comprises two downwardly extending members formed thereon; and (c) said at least one stop comprises two substantially planar members extending perpendicularly therefrom so as to abut the side of the carton within the cutout.

4. The bracket as recited in claim 1 wherein said plural column portions comprise a plurality of substantially planer members extending vertically intermediate said upper beam portion and said lower beam portion.

5. The bracket as recited in claim 1 wherein said upper beam portion, said lower bean portion, said plural column portions, said stops and said detent means are configured to accommodate a Maxco produce carton.

6. The bracket as recited in claim 1 wherein said upper beam portion, said lower beam portion, said plural column portions, said stops and said detent means are configured to accommodate a Weyerhauser produce carton.

7. The bracket as recited in claim 1 further comprising a stacking alignment tab formed upon said upper beam portion.

8. The bracket as recited in claim 7 wherein said stop is configured to substantially cover the top and side walls of the cutouts and to receive the stacking alignment tab formed upon said upper beam portion.

9. The bracket as recited in claim 1 further comprising a brace formed proximate a produce carton stacking alignment tab formed upon the produce carton for augmenting the stacking strength thereof.

10. A bracket for strengthening a produce carton, the carton having a bottom, sides, and ends, cutouts being formed at the intersection of the bottom and ends, the bracket comprising:

a) a horizontally oriented substantially planer upper beam portion extending along one end of the carton and having at least one hook member depending therefrom such that said upper beam portion hooks over the end of the carton;

b) a vertically oriented substantially planar lower beam portion extending along the end of the carton and having two downwardly extending detents formed thereon for being received by and engaging said cutouts to removably attach the bracket to the carton and also having two substantially planar stops extending perpendicularly therefrom so as to abut the side of the carton within the cutout and prevent upward movement of the bracket after the detents have engaged the cutouts;

c) a plurality of substantially planar interconnecting members extending vertically intermediate said upper beam portion and said lower beam portion and attaching said upper beam portion and said lower beam portion rigidly together; and d) wherein the bracket is easily installed upon the carton by hooking the upper beam portion over the end of the carton and snapping the detent means of the lower beam portion into the cutouts.

11. A reinforced produce carton comprising:

a) a bottom;

b) two sides formed to said bottom;

c) two ends formed to said bottom;

d) cutouts formed adjacent the intersection of the bottom and ends; and e) a bracket, wherein said bracket comprises:

(i) an upper beam portion extending along one end of the carton and configured to hook over that end of the carton;

(ii) a lower beam portion extending along the same end of the carton and having detent means formed thereon for engaging at least one of the cutouts to removably attach the bracket to the carton, the lower beam portion also having at least one stop formed thereon for engaging at least one of the cutouts to prevent upward movement of the bracket after the detent means have engaged the cutouts;

(iii) plural column portions rigidly attaching said upper beam portion to said lower beam portion; and iv) wherein the bracket is disposed within the carton by hooking the upper beam portion over the end of the carton and snapping the detent means of the lower beam portion into the cutouts.

12. The reinforced produce carton as recited in claim 11 wherein said upper beam portion comprises a horizontally oriented substantially planar member having at least one hook member depending therefrom.

13. The reinforced produce carton as recited in claim 11 wherein:

(a) said lower beam portion comprises a vertically oriented substantially planer member;

(b) said detent means comprises two downwardly extending members formed thereon; and (c) said at least one stop comprises two substantially planar members extending perpendicularly therefrom so as to abut the side of the carton within the cutout.

14. The reinforced produce carton as recited in claim 11 wherein said plural column portions comprise a plurality of substantially planer members extending vertically intermediate said upper beam portion and said lower beam portion.

15. The reinforced produce carton as recited in claim 11 wherein said upper beam portion, said lower beam portion, said plural column portions, said stops and said detent means are configured to accommodate a Maxco produce carton.

16. The reinforced produce carton as recited in claim 11 wherein said upper beam portion, said lower beam portion, said plural column portions, said stops and said detent means are configured to accommodate a Weyerhauser produce carton.

17. The reinforced produce carton as recited in claim 11 further comprising a stacking alignment tab formed upon said upper beam portion.

18. The reinforced produce carton as recited in claim 17 wherein said stop is configured to substantially cover the top and side walls of the cutouts and to receive the stacking alignment tab formed upon said upper beam portion.

19. The reinforced produce carton as recited in claim 17 further comprising a brace formed proximate a produce carton stacking alignment tab formed upon the produce carton for augmenting the stacking strength thereof.

20. A reinforced produce carton comprising:

a) a bottom;

b) two sides formed to said bottom;

c) two ends formed to said bottom;

d) cutouts formed adjacent the intersection of the bottom and ends; and e) a bracket comprising:

(i) a horizontally oriented substantially planer upper beam portion extending along one end of the carton and having at least one hook member depending therefrom such that said upper beam portion hooks over the end of the carton;

(ii) a vertically oriented substantially planar lower beam portion extending along the end of the carton and having two downwardly extending detents formed thereon for being received by and engaging said cutouts to removably attach the bracket to the carton and also having two substantially planar stops extending perpendicularly therefrom so as to abut the side of the carton within the cutout and prevent upward movement of the bracket after the detents have engaged the cutouts;

(iii) a plurality of substantially planar interconnecting members extending vertically intermediate said upper beam portion and said lower beam portion and attaching said beam portion member and said lower beam portion rigidly together; and (iv) wherein the bracket is easily installed upon the carton by hooking the upper beam portion over the end of the carton and snapping the detent means of the lower beam portion into the cutouts.

* * * * *